US011982450B2

(12) United States Patent
Zhu et al.

(10) Patent No.: US 11,982,450 B2
(45) Date of Patent: May 14, 2024

(54) AIR CONDITIONER INDOOR UNIT

(71) Applicant: GD MIDEA AIR-CONDITIONING EQUIPMENT CO., LTD., Foshan (CN)

(72) Inventors: Maocheng Zhu, Foshan (CN); Shengqi Li, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 199 days.

(21) Appl. No.: 16/776,816

(22) Filed: Jan. 30, 2020

(65) Prior Publication Data

US 2020/0166223 A1 May 28, 2020

Related U.S. Application Data

(63) Continuation of application No. PCT/CN2018/084927, filed on Apr. 27, 2018.

(30) Foreign Application Priority Data

Jul. 31, 2017 (CN) ..... 201710642312.6
Jul. 31, 2017 (CN) ..... 201720949029.3

(51) Int. Cl.
*F24F 13/14* (2006.01)
*F24F 1/0014* (2019.01)

(52) U.S. Cl.
CPC ..... *F24F 1/0014* (2013.01); *F24F 13/1413* (2013.01)

(58) Field of Classification Search
CPC .... F24F 7/06; F24F 13/06; F24F 13/08; F24F 13/10; F24F 13/14; F24F 13/1413;
(Continued)

(56) References Cited

U.S. PATENT DOCUMENTS 9,605,695 B2 * 3/2017 Sawchuk ..... F15D 1/025
2010/0307717 A1 * 12/2010 Yamashita ..... F24F 13/22 165/96
2016/0033162 A1 * 2/2016 Hirakawa ..... F24F 11/79 62/263

FOREIGN PATENT DOCUMENTS

CN 2731543 Y 10/2005
CN 2731543 Y * 10/2005
(Continued)

OTHER PUBLICATIONS

Sawchuk, Daniel, "Fluid Flow Conditioning", Aug. 24, 2015, Canada Pipeline Accessories, pp. 6, 81-82 [Retrieved on Dec. 6, 2021]. Retrieved from <Archive.org, https://web.archive.org/web/20161020214252/http://rmmsociety.org/wp-content/uploads/2014/11/CPA-Flow-Conditioning-Danny-Sawchuk.pdf>. (Year: 2015).*
(Continued)

*Primary Examiner* — Allen R. B. Schult
*Assistant Examiner* — William C Weinert
(74) *Attorney, Agent, or Firm* — Anova Law Group, PLLC

(57) ABSTRACT

An air conditioner indoor unit includes a body including an air outlet, an outer air deflector arranged at the air outlet and configured to open and close the air outlet, and an inner air deflector arranged at an inner side of the outer air deflector. The outer air deflector includes a plurality of first vent holes penetrating the outer air deflector in a thickness direction of the outer air deflector. The inner air deflector includes a plurality of second vent holes penetrating the inner air deflector in a thickness direction of the inner air deflector.

19 Claims, 14 Drawing Sheets

(58) Field of Classification Search
CPC .. F24F 1/0011; F24F 1/00; F24F 11/00; F24F 1/0014; F24F 2013/0616; F24F 2013/08; F24F 2221/17
USPC ..... 454/233
See application file for complete search history.

(56) References Cited

FOREIGN PATENT DOCUMENTS

| | | | | | |
|---|---|---|---|---|---|
| CN | 102252407 | A | | 11/2011 | |
| CN | 202254163 | U | | 5/2012 | |
| CN | 203375639 | U | | 1/2014 | |
| CN | 203375639 | U | * | 1/2014 | |
| CN | 203642435 | U | | 6/2014 | |
| CN | 104676758 | A | | 6/2015 | |
| CN | 104676864 | A | | 6/2015 | |
| CN | 104676866 | A | | 6/2015 | |
| CN | 104697055 | A | * | 6/2015 | ..... F24F 13/10 |
| CN | 104697055 | A | | 6/2015 | |
| CN | 104697056 | A | * | 6/2015 | ..... F24F 11/30 |
| CN | 104697056 | A | | 6/2015 | |
| CN | 104697058 | A | | 6/2015 | |
| CN | 104697058 | A | * | 6/2015 | ..... F24F 11/30 |
| CN | 204555022 | U | | 8/2015 | |
| CN | 204555023 | U | | 8/2015 | |
| CN | 104913444 | A | * | 9/2015 | ..... F24F 11/0012 |
| CN | 105003965 | A | | 10/2015 | |
| CN | 204786798 | U | * | 11/2015 | |
| CN | 204786798 | U | | 11/2015 | |
| CN | 105135519 | A | | 12/2015 | |
| CN | 105176046 | A | * | 12/2015 | |
| CN | 204901976 | U | * | 12/2015 | |
| CN | 204901976 | U | | 12/2015 | |
| CN | 105423521 | A | * | 3/2016 | |
| CN | 105444266 | A | | 3/2016 | |
| CN | 105444387 | A | | 3/2016 | |
| CN | 105444387 | A | * | 3/2016 | ..... F24F 1/0011 |
| CN | 106123120 | A | * | 11/2016 | ..... F24F 1/0003 |
| CN | 106152270 | A | | 11/2016 | |
| CN | 206018823 | U | | 3/2017 | |
| CN | 206018823 | U | * | 3/2017 | |
| CN | 106839119 | A | | 6/2017 | |
| CN | 106949615 | A | | 7/2017 | |
| CN | 106958864 | A | * | 7/2017 | |
| CN | 207146545 | U | | 3/2018 | |
| JP | H1137537 | A | * | 7/1997 | ..... F24F 1/0011 |
| JP | 2002277038 | A | | 9/2002 | |
| JP | 2004101072 | A | * | 4/2004 | |
| JP | 2004177097 | A | | 6/2004 | |
| JP | 3748046 | B2 | | 2/2006 | |
| JP | 2015206495 | A | | 11/2015 | |
| KR | 20080060845 | A | | 7/2008 | |
| KR | 20100008860 | U | * | 9/2010 | |
| KR | 101352653 | B1 | * | 1/2014 | |
| SE | 1050539 | A1 | * | 5/2010 | ..... F24F 13/06 |
| SE | 1050539 | A1 | * | 12/2011 | |
| WO | 2017024637 | A1 | | 2/2017 | |
| WO | 2017024638 | A1 | | 2/2017 | |
| WO | WO-2017024635 | A1 | * | 2/2017 | ..... F24F 11/00 |

OTHER PUBLICATIONS

CN-104913444—A machine translation (Year: 2022).*
CN-104697055—A machine translation (Year: 2022).*
CN-105444387—A machine translation (Year: 2022).*
CN-106123120—A machine translation (Year: 2022).*
SE 1050539 A1 machine translation (Year: 2022).*
CN-204901976-U machine translation (Year: 2022).*
CN-104697058-A translation (Year: 2023).*
Japan Patent Office Reasons for Refusal For Japanese Application No. 2019-557422 dated Dec. 1, 2020 10 Pages (including English translation).
World Intellectual Property Organization (WIPO) International Search Report for PCT/CN2018/084927 dated Jul. 9, 2018 7 Pages.
The State Intellectual Property Office of PRC (SIPO) The First Office Action For CN Application No. 201810418772.5 dated Dec. 18, 2019 14 Pages (Translation Included ).
The State Intellectual Property Office of PRC (SIPO) The First Office Action For CN Application No. 201810418720.8 dated Dec. 17, 2019 14 Pages (Translation Included ).
The State Intellectual Property Office of PRC (SIPO) The First Office Action For CN Application No. 201810418719.5 dated Apr. 25, 2019 12 Pages (Translation Included ).
The State Intellectual Property Office of PRC (SIPO) The Second Office Action For CN Application No. 201810418719.5 dated Jan. 7, 2020 13 Pages (Translation Included ).
Intellectual Property Australia (IPA) The Office Action For Australia Application No. 2018311608 dated Nov. 4, 2020 4 Pages.
The European Patent Office (EPO) Extended Search Report for EP Application No. 18841965.9 dated Mar. 31, 2020 9 Pages.
The State Intellectual Property Office of PRC (SIPO) The Second Office Action For CN Application No. 201810418772.5 dated May 8, 2020 11 Pages (Translation Included ).
The State Intellectual Property Office of PRC (SIPO) The Second Office Action For CN Application No. 201810407435.6 dated May 8, 2020 27 Pages (Translation Included ).
The China National Intellectual Property Administration (CNIPA) The Notice of the First Review Opinion for Chinese Application 202110841163.2 dated Mar. 21, 2022 16 Pages (With Translation).
Korean Intellectual Property Office (KIPO) The Notification of Reason for Refusal No. 10-2020-7003388 dated Oct. 26, 2021 14 Pages (Translation Included ).
Korean Intellectual Property Office (KIPO) The Notice of Submission of Opinion For KR Application No. 10-2020-7003388 dated Apr. 26, 2022 19 Pages (Translation Included ).

* cited by examiner

AIR CONDITIONER INDOOR UNIT

CROSS-REFERENCE TO RELATED APPLICATIONS

This application is a continuation of International Application No. PCT/CN2018/084927, filed Apr. 27, 2018, which claims priority to Chinese Application Nos. 201710642312.6 and 201720949029.3, both filed Jul. 31, 2017, the entire contents of all of which are incorporated herein by reference.

FIELD

The present disclosure relates to a technical field of household appliances, and especially to an air conditioner indoor unit.

BACKGROUND

With the improvement of living standard, consumers have attached an increasing importance to user experience of goods. In terms of air conditioner, comfortable experience is required in addition to cooling and heating. The users usually turn on the air conditioner for cooling in hot summer, but it is not comfortable if the cold wind directly blows toward them. Some physically weak people, including elders, pregnant women, and children, are vulnerable to disease related to air conditioning.

SUMMARY

The purpose of the present disclosure is to address at least one of the technical problems existing in the related art. For this purpose, the present disclosure proposes an air conditioner indoor unit, which can achieve an effect of no wind or breeze.

The air conditioner indoor unit comprises according to the present disclosure: a body that is provided with an air outlet; an outer air deflector that is arranged at the air outlet to open and close the air outlet, a plurality of first vent holes being formed in the outer air deflector and penetrating the outer air deflector in a thickness direction; and an inner air deflector that is arranged at the air outlet and inside the outer air deflector, a plurality of second vent holes being formed in the inner air deflector and penetrating the inner air deflector in the thickness direction.

In the air conditioner indoor unit in the present disclosure, the first vent holes and the second vent holes formed in the outer air deflector and the inner air deflector can reduce the air speed and volume at the air outlet and achieve the effect of breeze or no wind. In addition, the air conditioner indoor unit can switch among various wind modes and improve the user experience.

In some embodiments, any of the first vent holes and the second vent holes has a first hole section and a second hole section that are connected sequentially in an air outlet direction, and an outlet size of the first hole section is larger than an inlet size of the second hole section to form a parting surface.

In some embodiments, the first hole section tapers in the air outlet direction gradually, while the second hole section expands in the air outlet direction gradually.

In some embodiments, the parting surface is a plane.

In some embodiments, an inlet area of any one of the first vent holes and the second vent holes is not larger than an outlet area thereof.

In some embodiments, a distance between a parting surface and an outlet end of the first vent hole is not more than half of a total length of the first vent hole, and/or, a distance between a parting surface and an outlet end of the second vent hole is not more than half of a total length of the second vent hole.

In some embodiments, hole diameters of at least a part of the plurality of first vent holes decrease or increase sequentially or keep unchanged from top to bottom, and/or, hole diameters of at least a part of the plurality of second vent holes decrease and increase sequentially or keep unchanged from top to bottom.

In some embodiments, at least a part of the plurality of first vent holes are sequentially arranged along a preset straight line or curve, and/or, at least a part of the plurality of second vent holes are sequentially arranged along a preset straight line or curve.

In some embodiments, the hole diameter of the first vent hole ranges from 2 mm to 4 mm, and/or, the hole diameter of the second vent hole ranges from 4 mm to 8 mm.

In some embodiments, an included angle between a center axis of the first vent hole and the horizontal plane ranges from −10° to 10° when the outer air deflector is perpendicular to the air outlet direction, and/or, an included angle between a center axis of the second vent hole and the horizontal plane ranges from −10° to 10° when the inner air deflector is perpendicular to the air outlet direction.

In some embodiments, a total area of inner air deflector is no less than 45% of an area of the air outlet.

In some embodiments, the sum of areas of the plurality of second vent holes in the inner air deflector is no less than 50% of a total area of the inner air deflector.

In some embodiments, a projection area of the inner air deflector in a thickness direction thereof is no less than 70% of a total area of the air outlet.

In some embodiments, the outer air deflector is rotatable between a first wind state and a first open state, and the outer air deflector opens the air outlet when in the first open state and closes the air outlet when in the first wind state.

In some embodiments, the inner air deflector is rotatable between a second wind state and a second open state, the inner air deflector extends into the air outlet and is arranged along the air outlet direction when in the second open state, and the inner air deflector is flush with an outer contour of the body when in the second wind state.

In some embodiments, either of inner air deflector and outer air deflector is made of at least one material selected from ordinary ABS, modified ABS, PC and modified PC.

In some embodiments, any one of the first vent holes and the second vent holes has a round, oval, triangular or polygonal cross section.

Additional aspects and the advantages of the present disclosure will be given partially in the following description, part of which becomes obvious or be understood through the practice of the present disclosure.

Figure 1:
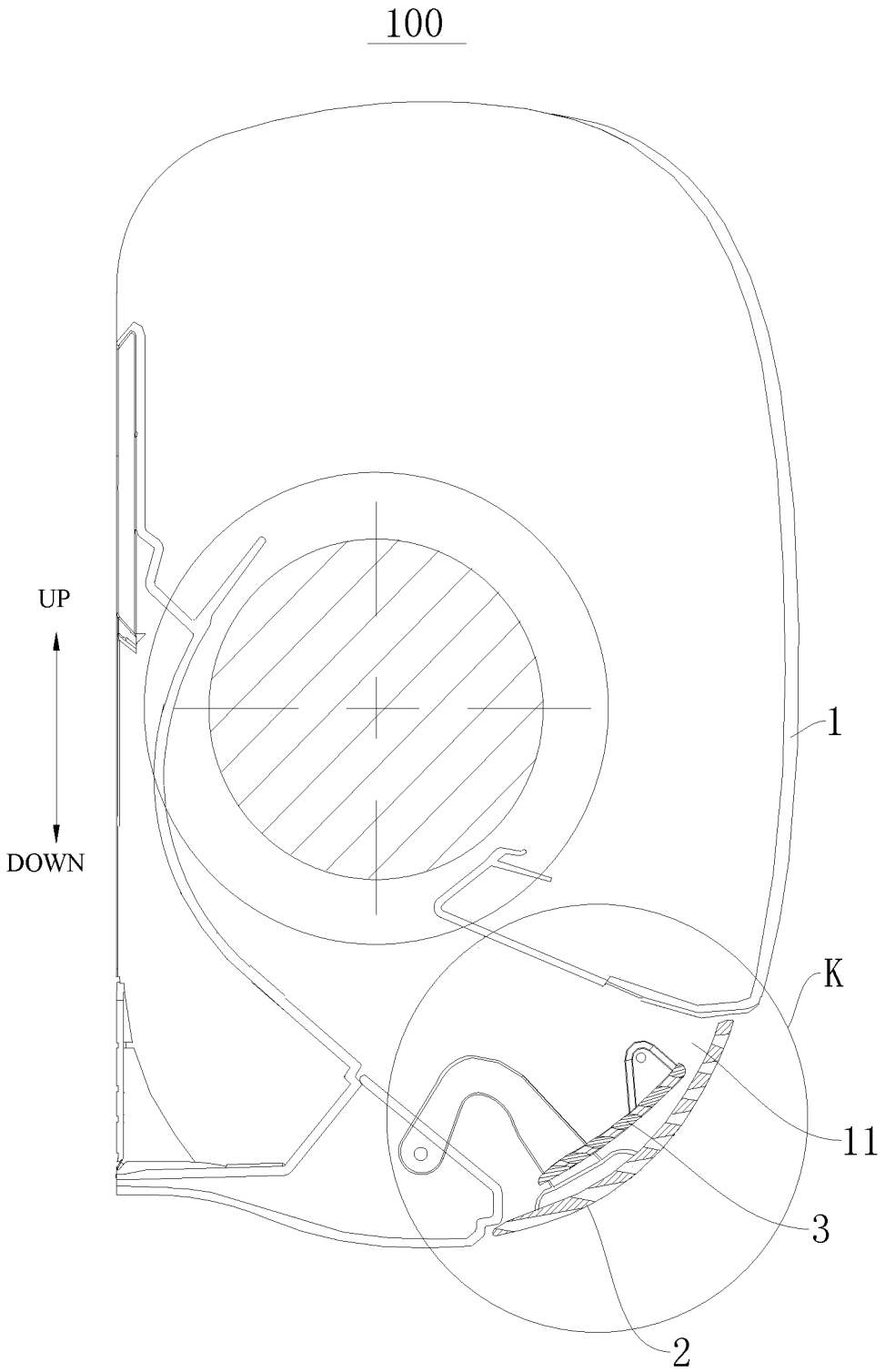
FIG. 1 is a schematic cross-sectional view of the air conditioner indoor unit according to embodiments of the present disclosure, where the outer air deflector closes the air outlet and the inner air deflector is in the second wind state.

REFERENCE NUMERALS air conditioner indoor unit 100,
body 1, air outlet 11,
outer air deflector 2, first vent hole 21, first hole section 211, second hole section 212, parting surface 213,
inner air deflector 3, second vent hole 31, first hole section 311, second hole section 312, parting surface 313.

DETAILED DESCRIPTION

The embodiments of the present disclosure are described in detail below, and examples of the embodiments are shown in the attached drawings, throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure. The following FIGS. 1-14 show an air conditioner indoor unit 100 consistent with embodiments of the present disclosure. The indoor unit 100 and the outdoor unit are assembled into an air conditioner to regulate the indoor ambient temperature. The air conditioner can be a split wall-mounted air conditioner and the air conditioner can have only a cooling function or both the cooling function and a heating function. The present disclosure takes an air conditioner having both cooling and heating functions as an example for illustration. The indoor unit 100 can have a windless mode, a first breeze mode, a second breeze mode, a cooling wind mode and a heating wind mode.

Figure 2:
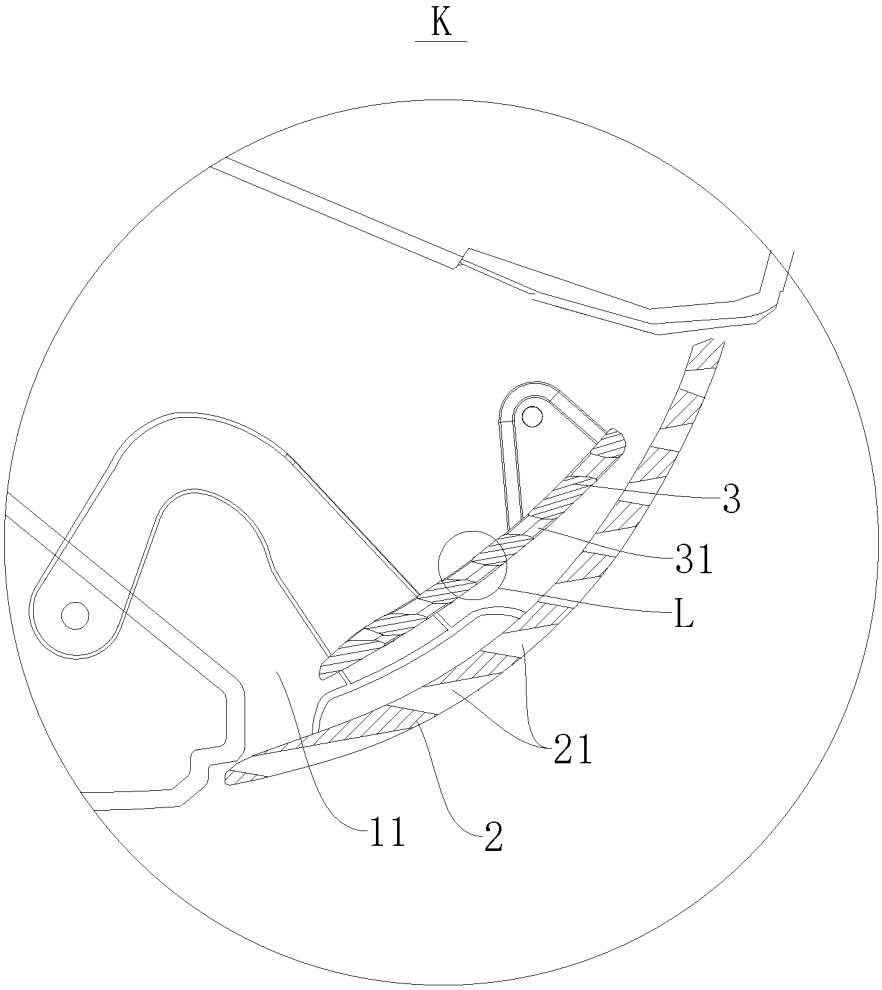
FIG. 2 is an enlarged view of Part K circled in FIG. 1.
Figure 3:
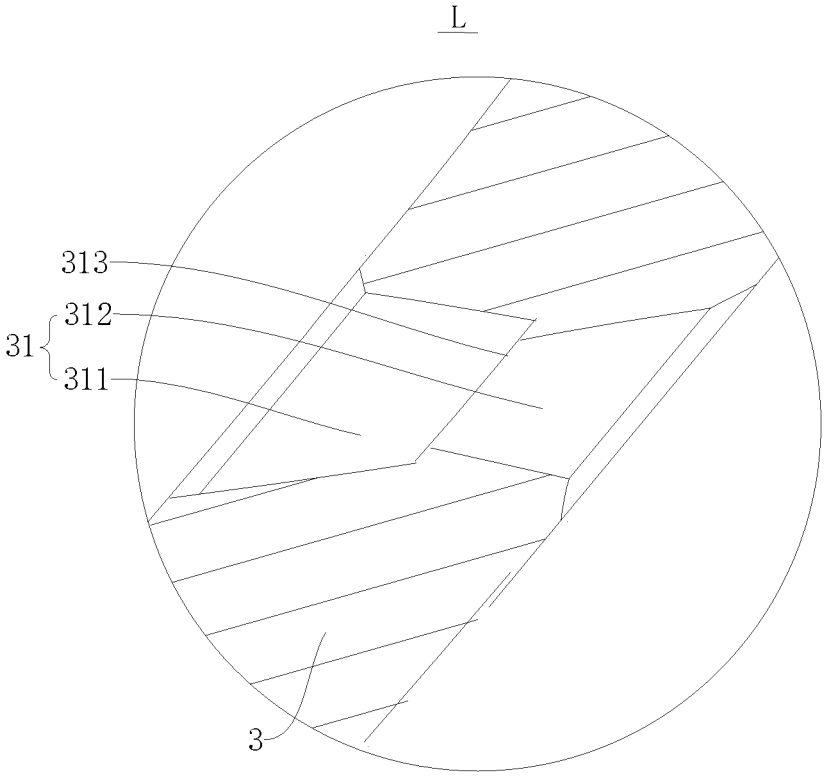
FIG. 3 is an enlarged view of Part L circled in FIG. 2.

As shown in FIGS. 1-3, the indoor unit 100 according to embodiments of the present disclosure includes: body 1, outer air deflector 2 and inner air deflector 3. All components of the indoor unit 100 can be housed in the body 1. The body 1 not only can support and protect the internal components, but also can have a certain decoration effect.

The body 1 includes a chassis, a face frame and a panel, where the face frame is arranged on the chassis, with the front side open, the panel is arranged in front of the face frame, and an air outlet 11 is arranged between the lower end of the panel and the face frame. Specifically, the face frame can be arranged on the chassis in a rotatable or detachable manner, and the panel can be arranged on the face frame in a rotatable or detachable manner. It can be understood that an air outlet frame for air circulation is arranged in the body 1. The indoor unit 100 also comprises a heat exchanger, fan and electric control box arranged in the body 1.

Specifically, as shown in FIG. 1, FIG. 4, FIG. 6 and FIG. 8, the body 1 is provided with an air outlet 11; the outer air deflector 2 is arranged at the air outlet 11 to open and close the air outlet 11. For example, the outer air deflector 2 is in pivot connection with the edge of the air outlet 11 and can open and close the air outlet 11 through rotation. When the outer air deflector 2 opens the air outlet 11, the air flow can be blown into the room through the air outlet 11 and guided by the outer air deflector 2; when the air outlet 11 is closed, the outer air deflector 2 is flush with the outer contour of the body 1.

In some embodiments, the outer air deflector 2 can rotate around the rotating shaft to change a direction of the wind when the indoor unit 100 is working.

In some embodiments, a plurality of first vent holes 21 penetrating in the thickness direction of the outer air deflector 2 are formed in the outer air deflector 2. The cross section of the first vent hole 21 can be round, oval, triangular or polygonal.

Figure 5:
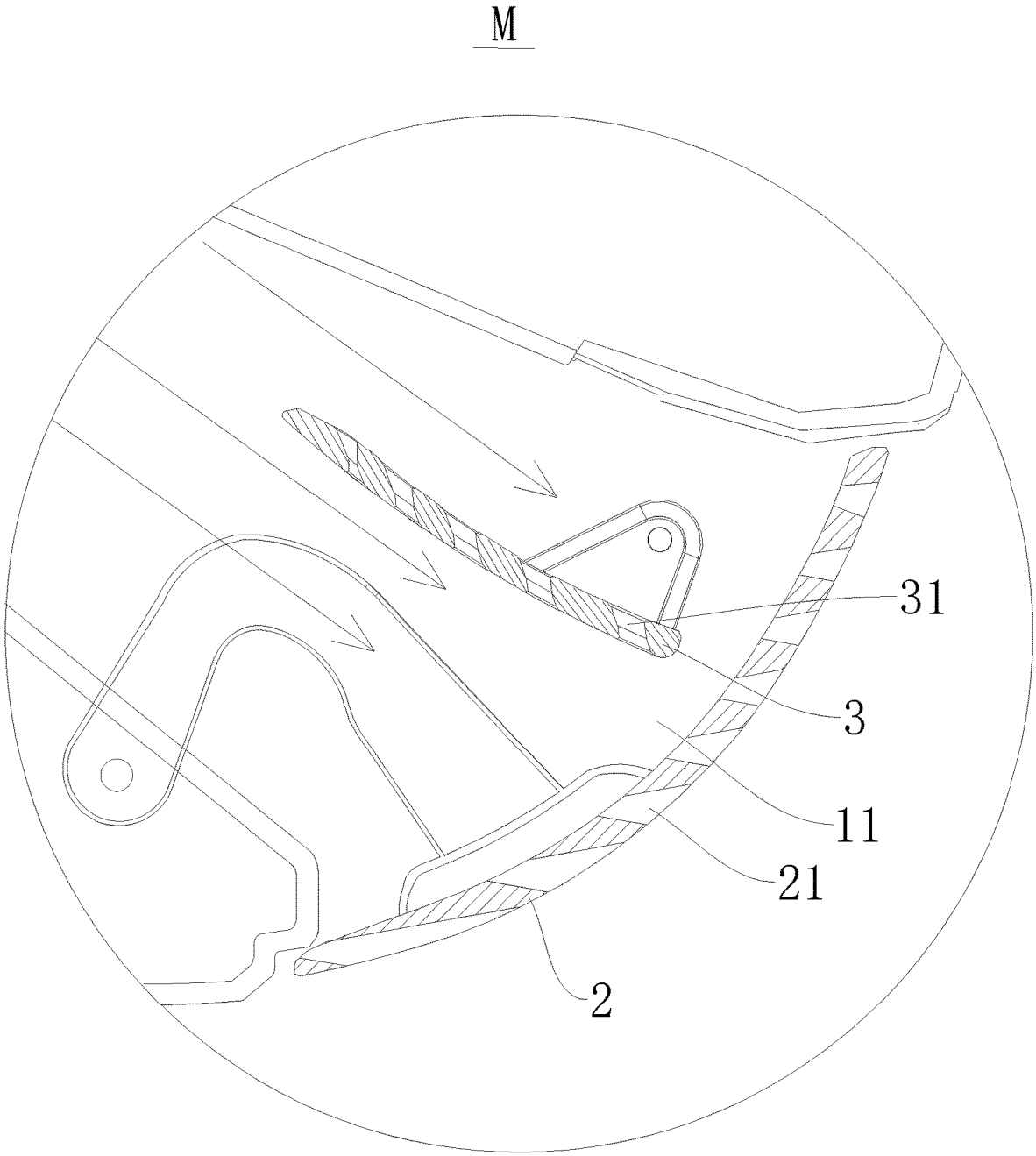
FIG. 5 is an enlarged view of Part M circled in FIG. 4.
Figure 7:
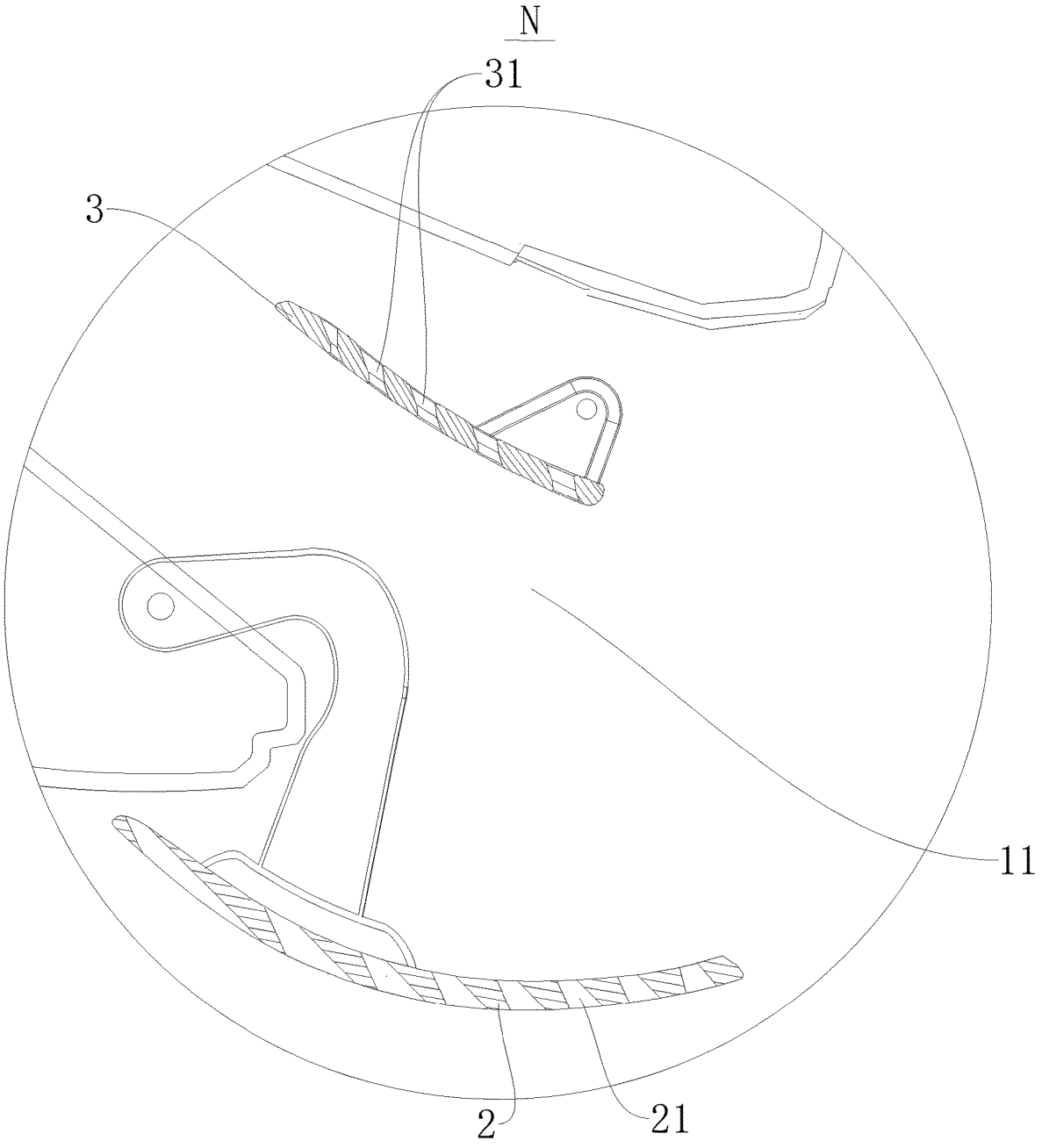
FIG. 7 is an enlarged view of Part N circled in FIG. 6.

In some embodiments, the outer air deflector 2 can rotate between the first wind state (as shown in FIG. 5) and the first open state (as shown in FIG. 7). The outer air deflector 2 opens the air outlet 11 when in the first open state, closes the air outlet 11 when in the first wind state and is flush with the outer contour of the machine body.

As shown in FIG. 5, when the outer air deflector 2 closes the air outlet 11 in the first wind state, the air flow in the body 1 can be blown from the first vent holes 21, the indoor unit 100 is in the first breeze mode at this moment, the outer air deflector 2 can stop the air flow to some extent, the air flow is only blown from the first vent holes 21, which can reduce the air speed and volume (nearly no wind) and achieve the no-wind effect. The air conditioner indoor unit can effectively prevent air flow from blowing to people, thereby avoiding air-conditioning related diseases and achieving a better user experience.

As shown in FIG. 7, when the outer air deflector 2 opens the air outlet 11 in the first open state, the air flow is blown directly from the air outlet 11, and the indoor unit 100 is in the wind mode.

The inner air deflector 3 is arranged at the air outlet 11 and at an inner side of the outer air deflector 2. In some embodiments, the inner air deflector 3 can be arranged at the air outlet 11 in a rotatable manner. When rotating to a certain angle, the inner air deflector 3 can guide the air flow to adjust the air outlet angle. In some embodiments, the inner air deflector 3 can rotate around the rotating shaft to swing the wind when the indoor unit 100 is working.

Further, a plurality of second vent holes 31 penetrating through the inner air deflector 3 in its thickness are formed in the inner air deflector 3. The cross section of the second vent hole 31 can be round, oval, triangular or polygonal.

Figure 9:
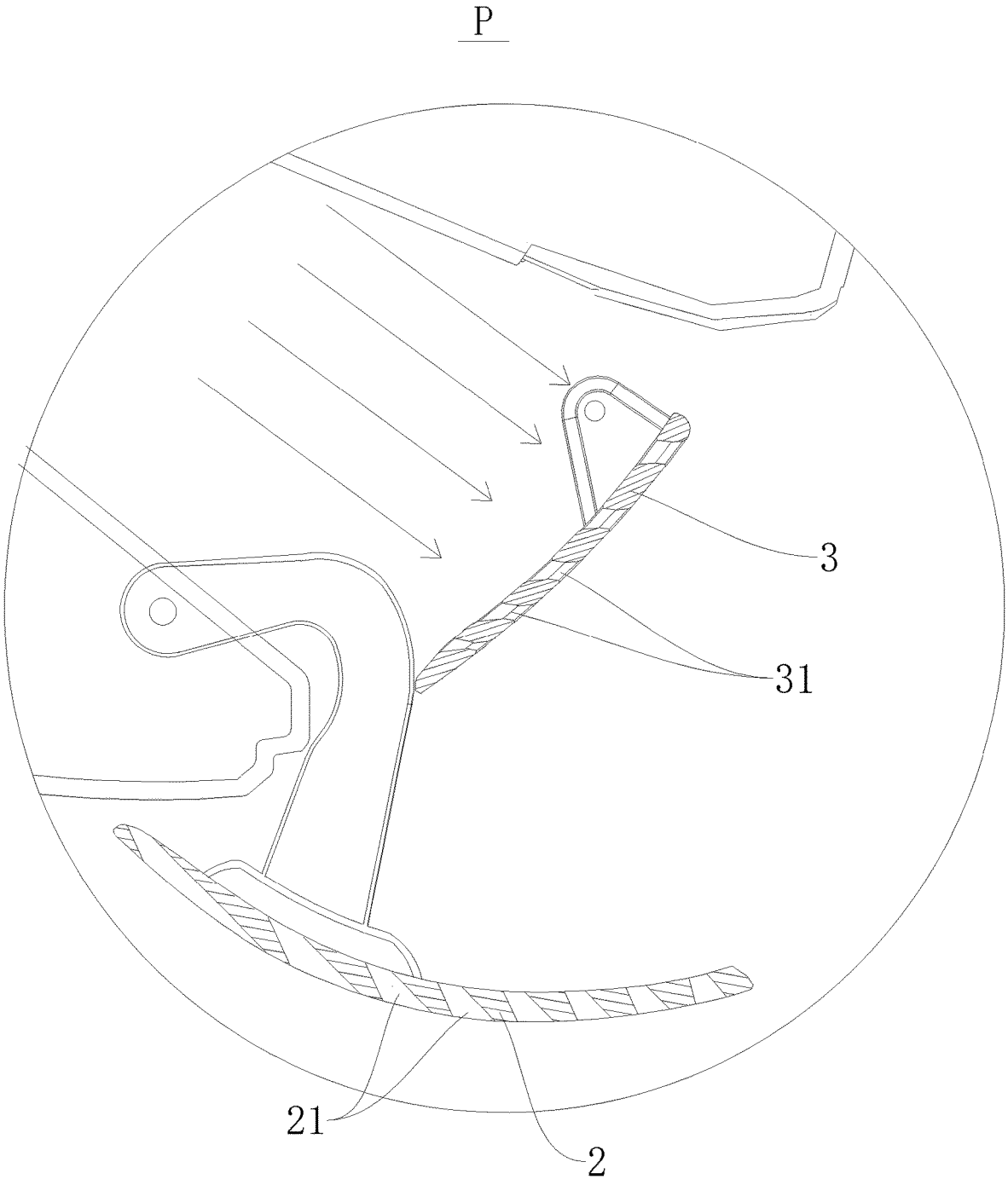
FIG. 9 is an enlarged view of Part P circled in FIG. 8.

In some embodiments, the inner air deflector 3 can rotate between the second wind state (as shown in FIG. 9) and the second open state (as shown in FIG. 7). As shown in FIG. 7, when the inner air deflector 3 is in the second open state, the inner air deflector 3 extends into the air outlet 11 and is arranged in the air outlet direction (i.e., the inner air deflector 3 is roughly parallel to the air outlet direction). At this moment, the air flow can be blown directly from the air outlet, the indoor unit 100 is in a wind mode, that is, the indoor unit 100 blows hot air or cool air directly, thereby adjusting the indoor temperature.

As shown in FIG. 9, the inner air deflector 3 is flush with the outer contour of the body 1 when in the second wind state (the inner air deflector 3 is roughly perpendicular to the air outlet direction). At this moment, the air flow can be blown from the second vent holes 31 of inner air deflector 3. When the indoor unit 100 is in the second wind mode, the inner air deflector 3 can stop the air flow to some extent, the air flow can only be blown from the second vent holes 31, thereby reducing the air speed and volume (nearly no wind) and achieving the no-wind effect. The air conditioner indoor unit can effectively prevent air flow from blowing to people, thereby avoiding air-condition disease and achieving better user experience.

Besides, as shown in FIG. 1 and FIG. 2, when the outer air deflector 2 is in the first wind state and the inner air deflector 3 is the second wind state, that is, the outer air deflector 2 is flush with an outer contour of the body, and the inner air deflector 3 is-roughly parallel to the outer air deflector 2, the air flow is blown from the second vent holes 31 in the inner air deflector 3 and the first vent holes 21 in the outer air deflector 2 sequentially, and the indoor unit 100 is in the no-wind mode. In this process, the inner air deflector 3 and the outer air deflector 2 can stop the air flow, thereby reducing the air speed and volume significantly and achieving the no-wind effect.

According to the indoor unit 100 of consistent with embodiments of the present disclosure, the first vent holes 21 and the second vent holes 31 formed in the outer air deflector 2 and the inner air deflector 3 can reduce the air speed and volume of the air outlet 11 and achieve the effect of breeze or no wind. In addition, the air conditioner indoor unit can switch among various wind modes and improve the user experience.

The outer air deflector 2 will be further described in connection with the drawings.

In one embodiment of the present disclosure, the sum of the areas of the plurality of first vent holes 21 in the outer air deflector 2 is no less than 50% of the total area of the outer air deflector 2. Therefore, the air conditioner indoor unit not only can reduce the outlet air speed and volume, but also can guarantee the cooling and heating effect of the indoor environment.

It should be noted that the total area of outer air deflector 2 comprises the areas of the first vent holes 21.

Figure 14:
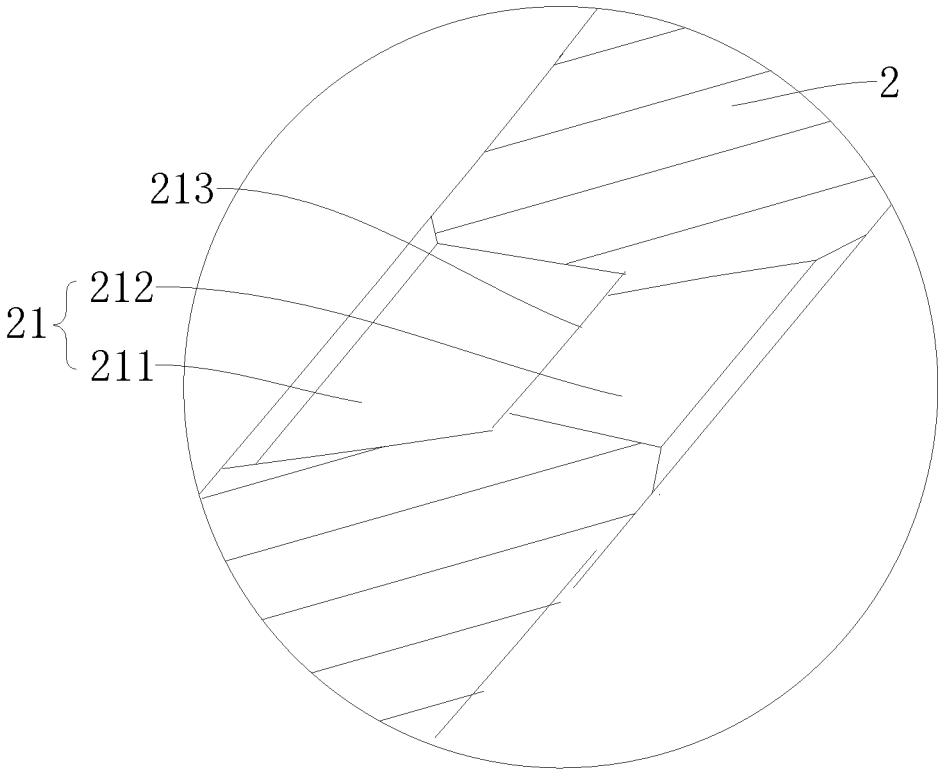
FIG. 14 is a schematic view of the first vent hole according to some embodiments of the present disclosure.

In some embodiment of the present disclosure, according to FIG. 14, the first vent hole 21 can comprise the first hole section 211 and the second hole section 212 which are connected sequentially in the air outlet direction, where the outlet size of the first hole section 211 is larger than the inlet size of the second hole section 212 so that a parting surface 213 is formed at the connection between the first hole section 211 and the second hole section 212. The parting surface 213 can further reduce the air speed and volume of air flow in the first vent holes 21, thereby further achieving the no-wind effect. Moreover, the parting surface 213 is also convenient for the forming of the first vent hole 21 and simplifying the structure.

Further, the first hole section 211 of the first vent hole 21 tapers gradually in the air outlet direction, while the second hole section 212 expands gradually in the air outlet direction. In other words, the hole diameter of the first hole section 211 in the air outlet direction is reduced gradually, and the hole diameter of the second hole section 212 is increased gradually. Therefore, the air volume of air flow in the first hole section 211 can be reduced gradually, and the air speed of air flow in the second hole section 212 can be reduced gradually, thereby achieving the no-wind effect. Optionally, according to FIG. 14, the parting surface 213 can be a plane. Therefore, the structure can be simplified to facilitate manufacturing, and the air volume and speed can be reduced.

In some embodiments, as shown in FIG. 2, the inlet area of the first vent hole 21 is not larger than the outlet area of the first vent hole 21, that is, the inlet area of the first vent hole 21 can be equal to the outlet area of the first vent hole 21, or the inlet area of the first vent hole 21 can be smaller than the outlet area of the first vent hole 21. Therefore, the outlet air speed of the first vent hole 21 can be controlled to be not higher than (e.g., to be lower than) the inlet air speed of the first vent hole 21, and the air volume and speed of the airflow can be reduced, and no-wind mode of air outlet can be realized. The present disclosure is not limited thereto. In some embodiments, the inlet area of the first vent hole 21 can be larger than the outlet area of the first vent hole 21, so as to reduce outlet wind volume.

In some embodiments, the distance between the parting surface of the first vent hole 21 and the outlet end of the first vent hole 21 is not more than half of the total length of the first vent hole 21. This further helps to achieve no-wind effect.

Figure 10:
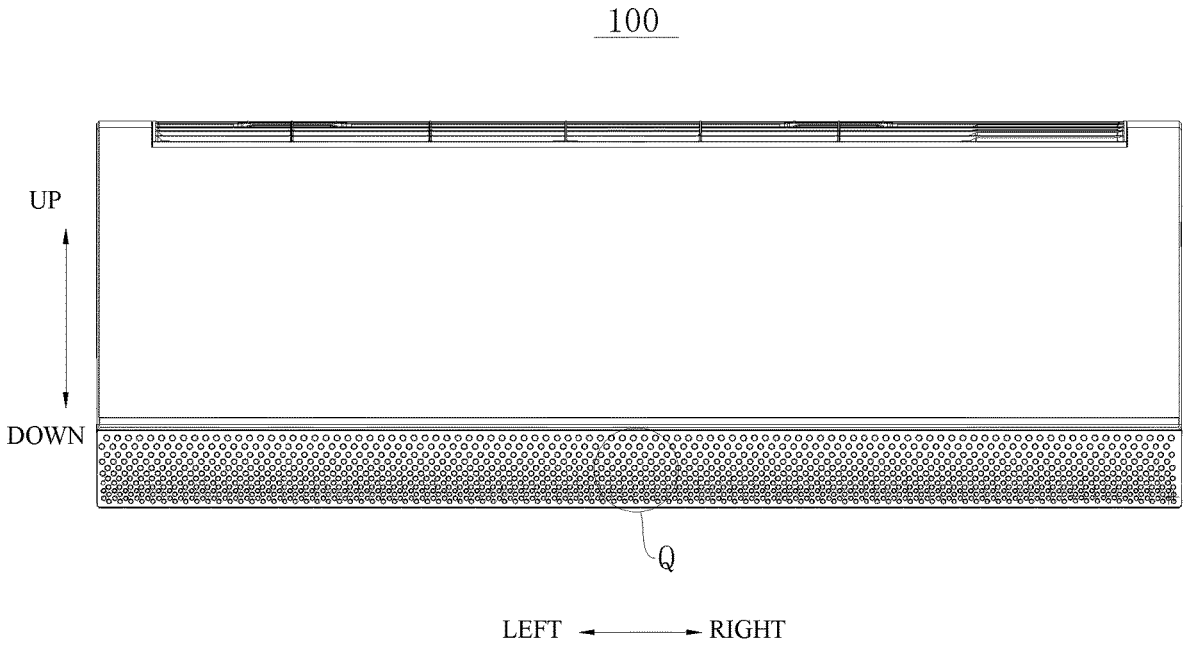
FIG. 10 is a schematic diagram of the air conditioner indoor unit shown in FIG. 4.
Figure 11:
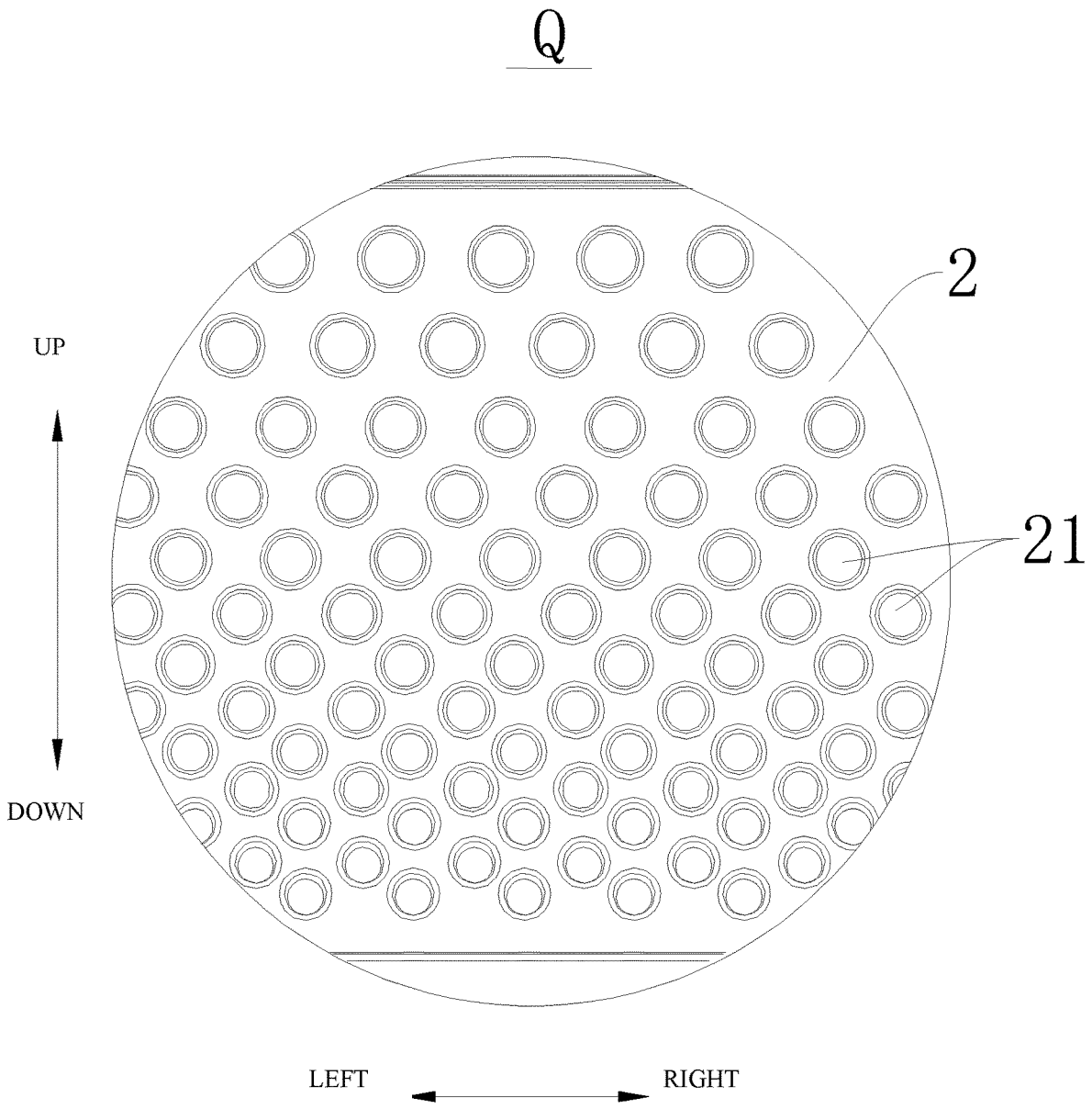
FIG. 11 is an enlarged view of Part Q circled in FIG. 10.

In some embodiments, as shown in FIG. 10 and FIG. 11, the hole diameters of at least a part of the plurality of first vent holes 21 are reduced/increased sequentially from top of the outer air deflector 2 to bottom of the outer air deflector 2, or remain unchanged. That is, the hole diameters of at least a part of the plurality of first vent holes 21 in the outer air deflector 2 can be reduced/increased sequentially from top to bottom, or the hole diameters can be the same, that is, remaining unchanged. Therefore, the hole diameters at different positions of outer air deflector 2 can be set according to the air outlet requirement, thereby improving the applicability.

In some embodiments, as shown in FIG. 10 and FIG. 11, at least a part of the plurality of first vent holes 21 can be set along the preset straight line or curve sequentially. Therefore, the positions of the first vent holes 21 can be set reasonably, and the appearance can be enhanced.

For example, multiple columns of first vent hole groups are arranged in the outer air deflector 2 in the length direction (the left-right direction as shown in FIG. 10), and each column of first vent hole group comprises the plurality of first vent holes 21 formed vertically at intervals. The plurality of first vent holes 21 in two adjacent columns of first vent hole groups are formed vertically in a staggered manner. In some other embodiments, the plurality of first vent holes 21 in two adjacent columns of first vent hole groups can be formed horizontally aligned.

It should be noted that the air speed and volume can be changed by changing the hole diameter of the first vent hole 21, which helps to achieve the no-wind effect. In some embodiments, the hole diameter of the first vent hole 21 is 2 mm-4 mm, thereby effectively reducing the air speed and volume while guaranteeing the cooling and heating rate.

As shown in FIG. 2, in some embodiments, when the outer air deflector 2 is perpendicular to the air outlet direction, the included angle between the center line of the first vent hole 21 and the horizontal plane is −10° to 10°. In some embodiments, when the outer air deflector 2 is perpendicular to the air outlet direction, the included angle between the center line of the first vent hole 21 and the horizontal plane is −5° to 5°. In some embodiments, when the outer air deflector 2 is perpendicular to the air outlet direction, the center line of the first vent hole 21 is roughly parallel to the horizontal plane. Therefore, the air flow can be blown horizontally rather than to the human body direction, thereby improving the user experience.

In some embodiments, the outer air deflector 2 is made of at least one of ordinary ABS (acrylonitrile-styrene-butadiene copolymer), modified ABS, PC (polycarbonate) or modified PC. The inner air deflector 3 will be further described in connection with the drawings.

In some embodiments of the present disclosure, the sum of the areas of the plurality of second vent holes 31 in the inner air deflector 3 is no less than 50% of the total area of the inner air deflector 3. Therefore, the air conditioner indoor unit not only can reduce the outlet air speed and volume, but also can guarantee the cooling and heating effect of indoor environment.

When the total area of the inner air deflector is too small, the reduction effect of air speed and volume at the air outlet 11 may not be ideal. Therefore, in some embodiments, the total area of the inner air deflector 3 no less than 45% of the area of the air outlet 11. Therefore, the air speed and volume can be effectively reduced when the inner air deflector is perpendicular to the air outlet direction, and the no-wind effect can be achieved. For example, the total area of the inner air deflector 3 can be larger than 55%, 65% or 75% of the area of the air outlet 11.

It should be noted that the total area of inner air deflector 3 comprises the areas of the second vent holes 31.

In some embodiments of the present disclosure, the projected area of the inner air deflector 3 in the thickness direction is no less than 70% of the total area of the air outlet 11. Therefore, the inner air deflector 3 can effectively stop the air volume and speed of the air outlet 11, to achieve no-wind effect and improve the user experience. For example, the projected area of the inner air deflector 3 in the thickness direction can be 80%, 85% or 90% of the total area of the air outlet 11.

In some embodiments of the present disclosure, as shown in FIG. 3, the second vent hole 31 can comprise the first hole section 311 and the second hole section 312 which are connected sequentially in the air outlet direction, where the outlet size of the first hole section 311 is smaller than the inlet size of the second hole section 312 so that the parting surface 313 can be formed at the connection between the first hole section 311 and the second hole section 312. The parting surface 313 can further reduce the air speed and volume of air flow in the second vent hole 31, thereby further achieving the no-wind effect. Moreover, the parting surface 313 is also convenient for the forming of the second vent hole 31 and simplifying the structure.

Further, as shown in FIG. 3, the first hole section 311 tapers gradually in the air outlet direction, while the second hole section 312 expands gradually in the air outlet direction. In other words, the hole diameter of the first hole section 311 in the air outlet direction is reduced gradually, and the hole diameter of the second hole section 312 is increased gradually. Therefore, the air volume of air flow in the first hole section 311 can be reduced gradually, and the air speed of air flow in the second hole section 312 can be reduced gradually, thereby achieving the no-wind effect.

Optionally, according to FIG. 3, the parting surface 313 in the second vent hole 31 can be a plane. Therefore, the parting surface can simplify the structure, facilitate machining and machining and reduce the air volume and speed.

In some embodiments, the inlet area of the second vent hole 31 is not larger than the outlet area of the second vent hole 31, that is, the inlet area of the second vent hole 31 can be equal to the outlet area of the second vent hole 31, or the inlet area of the second vent hole 31 can be smaller than the outlet area of the second vent hole 31. Therefore, the outlet air speed of the second vent hole 31 can be controlled to be not higher than (e.g., to be lower than) the inlet air speed of the second vent hole 31, the air volume and speed of the airflow can be reduced, and no-wind mode can be realized.

The present disclosure is not limited thereto. In some embodiments, the inlet area of the second vent hole 31 can be larger than the outlet area of the second vent hole 31, so as to reduce outlet wind volume.

In some embodiments, the distance between the parting surface 313 of the second vent hole 31 and the outlet end of the second vent hole 31 is not more than half of the total length of the second vent hole 31. This further helps to achieve no-wind effect.

Figure 12:
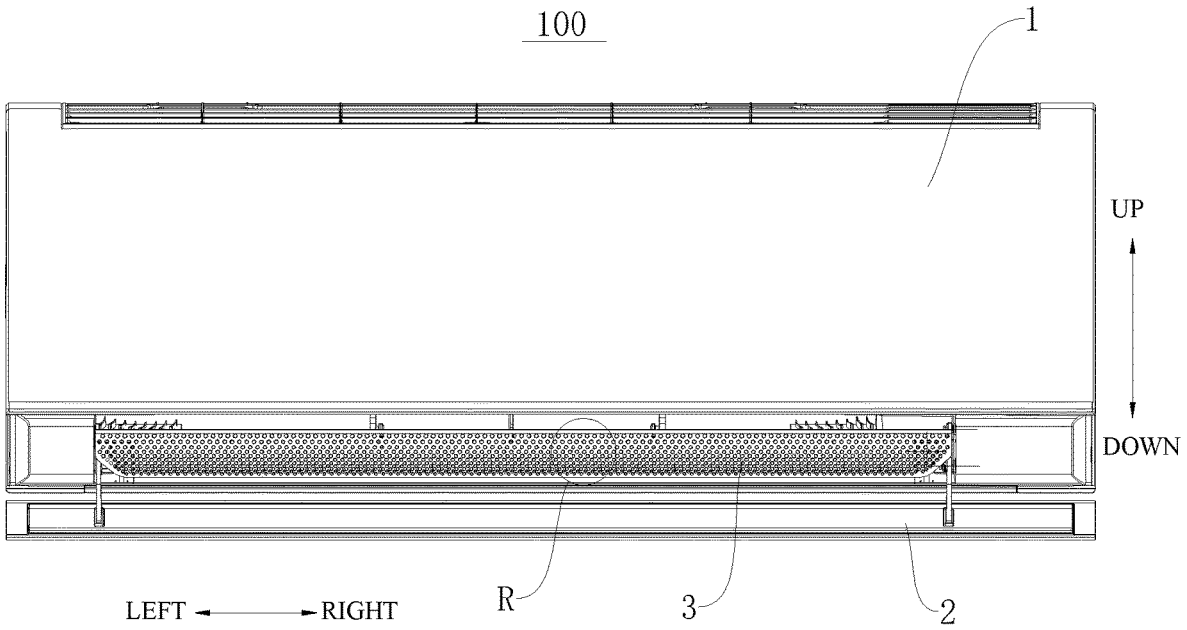
FIG. 12 is a schematic diagram of the air conditioner indoor unit shown in FIG. 8.
Figure 13:
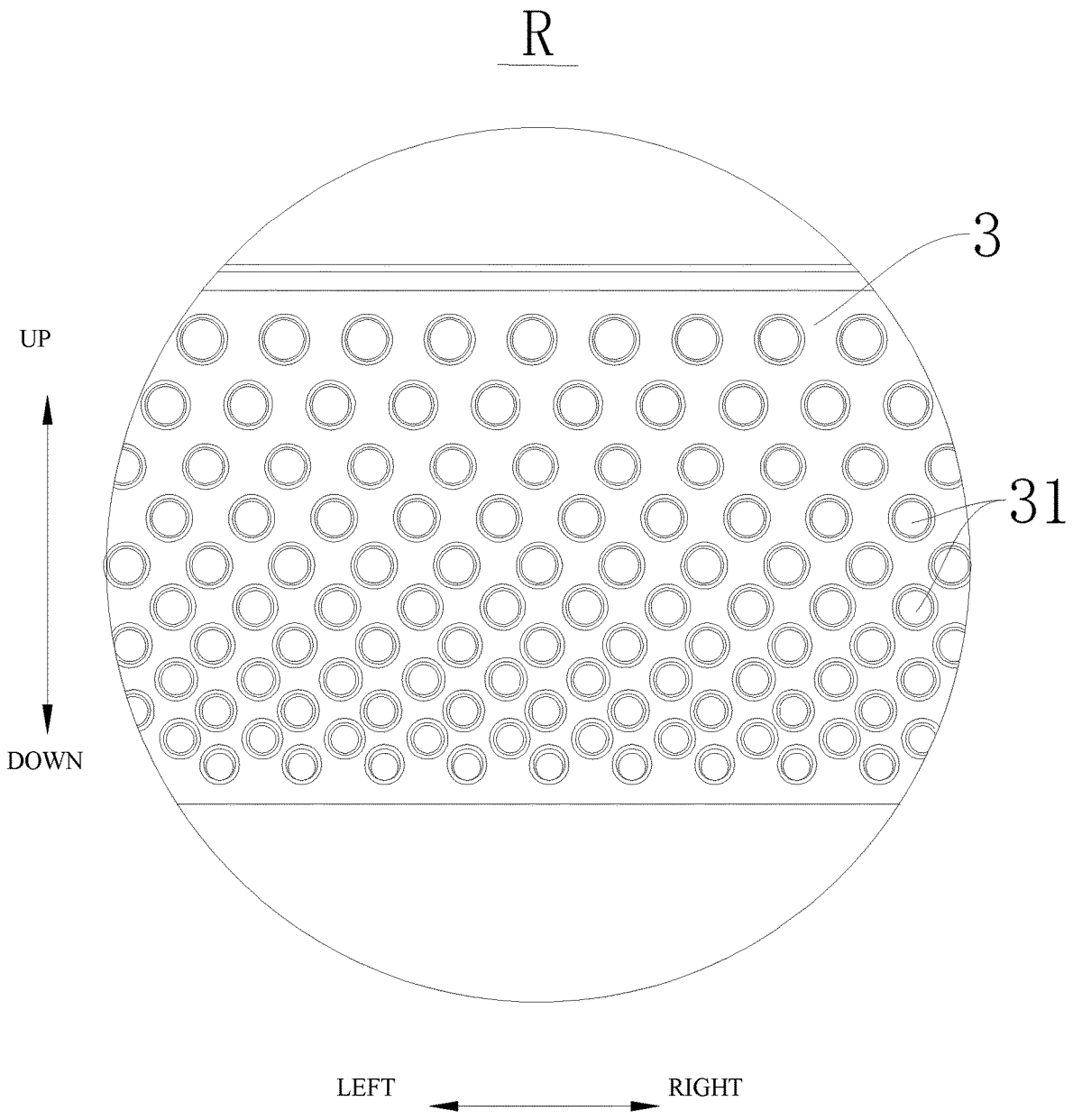
FIG. 13 is an enlarged view of Part R circled in FIG. 12.

In some embodiments, as shown in FIG. 12 and FIG. 13, the hole diameters of at least a part of the plurality of second vent holes 31 are reduced/increased sequentially from top of the inner air deflector 3 to bottom of the inner air deflector 3, or remain unchanged. That is, the hole diameters of at least a part of the plurality of second vent holes 31 in the inner air deflector 3 can be reduced/increased sequentially from top to bottom, or the hole diameters can be the same, that is, remaining unchanged. Therefore, the hole diameters at different positions of inner air deflector 3 can be set according to the air outlet requirement, thereby improving the applicability.

In some embodiments, at least a part of the plurality of second vent holes 31 can be set along the preset straight line or curve sequentially. Therefore, the positions of the second vent holes 31 can be set reasonably, and the appearance can be enhanced.

For example, multiple columns of second vent hole groups are arranged in the inner air deflector 3 in the length direction (the left-right direction as shown in FIG. 13), and each column of second vent hole group comprises the plurality of second vent holes 31 formed vertically at intervals. The plurality of second vent holes 31 in two adjacent columns of second vent hole groups are formed vertically in a staggered manner. In some other embodiments, the plurality of second vent holes 31 in two adjacent columns of second vent hole groups can be formed horizontally aligned.

The air speed and volume can be changed by changing the hole diameter of the second vent hole 31, which helps to achieve no-wind effect. In some embodiments, the hole diameter of the second vent hole 31 is 4 mm-8 mm, thereby effectively reducing the air speed and volume while guaranteeing the cooling and heating rate.

In some embodiments, as shown in FIG. 2, when the inner air deflector 3 is perpendicular to the air outlet direction, the included angle between the center line of the second vent hole 31 and the horizontal plane is −10° to 10°. In some embodiments, when the inner air deflector 3 is perpendicular to the air outlet direction, the included angle between the center line of the second vent hole 31 and the horizontal plane is −5° to 5®. In some embodiments, when the inner air deflector 3 is perpendicular to the air outlet direction, the center line of the second vent hole 31 is roughly parallel to the horizontal plane. Therefore, the air flow can be blown horizontally rather than to the human body direction, thereby improving the user experience.

In some embodiments, the inner air deflector 3 is made of at least one of ordinary ABS (acrylonitrile-styrene-butadiene copolymer), modified ABS, PC (polycarbonate) or modified PC.

The working process of the indoor unit 100 consistent with embodiments of the present disclosure is described as follows.

The indoor unit 100 consistent with embodiments of the present disclosure has no-wind mode, first breeze mode, second breeze mode, cooling wind mode and heating wind mode. When the indoor unit 100 is working, the indoor unit 100 is turned on and a selection of the air outlet mode is received.

Figure 8:
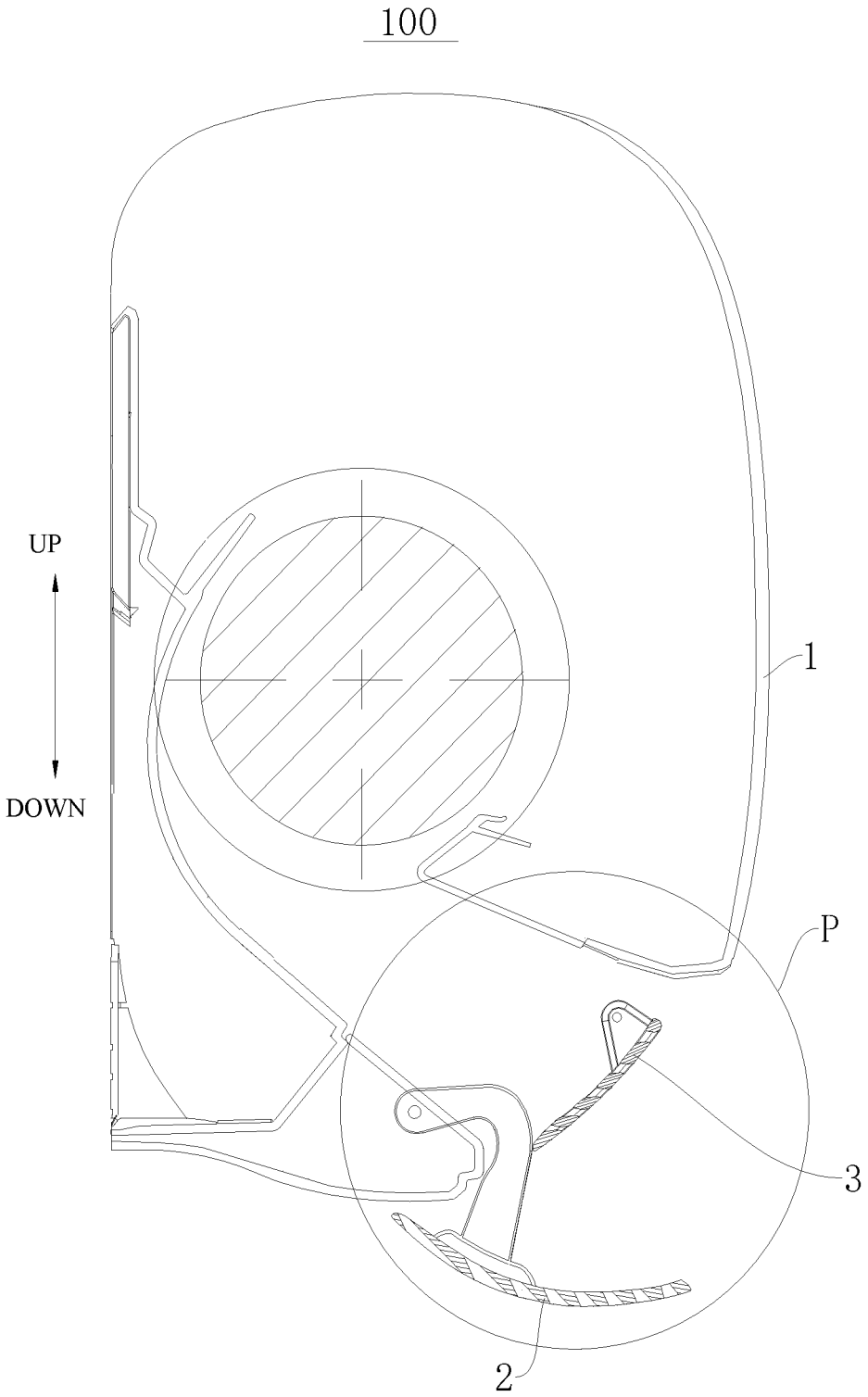
FIG. 8 is a schematic cross-sectional view of the air conditioner indoor unit according to embodiments of the present disclosure, where the outer air deflector opens the air outlet and the inner air deflector is in the second wind state.

When the first breeze mode is selected, the outer air deflector 2 opens the air outlet 11, the inner air deflector 3 rotates to a state in which the inner air deflector 3 is roughly perpendicular to the air outlet direction, as shown in FIGS. 8 and 9.

Figure 4:
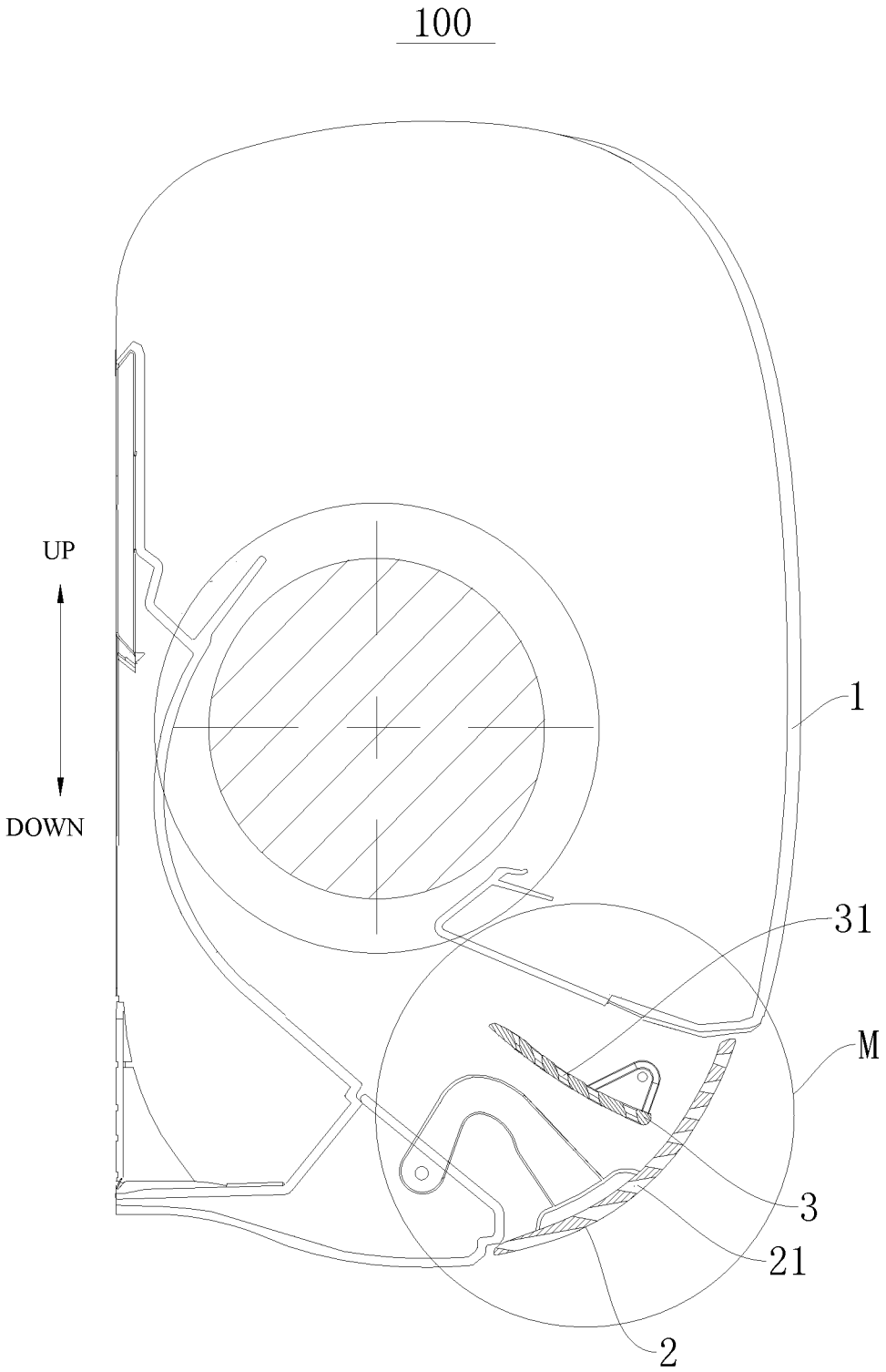
FIG. 4 is a schematic cross-sectional view of the air conditioner indoor unit according to embodiments of the present disclosure, where the outer air deflector closes the air outlet and the inner air deflector is in the second open state.

When the second breeze mode is selected, the outer air deflector 2 closes the air outlet 11, the inner air deflector 3 rotates to a state in which the inner air deflector 3 is roughly parallel to the air outlet direction, as shown in FIGS. 4 and 5.

When the no-wind mode is selected, the outer air deflector 2 rotates to the closing state (closes the air outlet 11), and the inner air deflector 3 rotates to a state in which the inner air deflector 3 is roughly perpendicular to the air outlet direction, as shown in FIG. 1 and FIG. 2.

Figure 6:
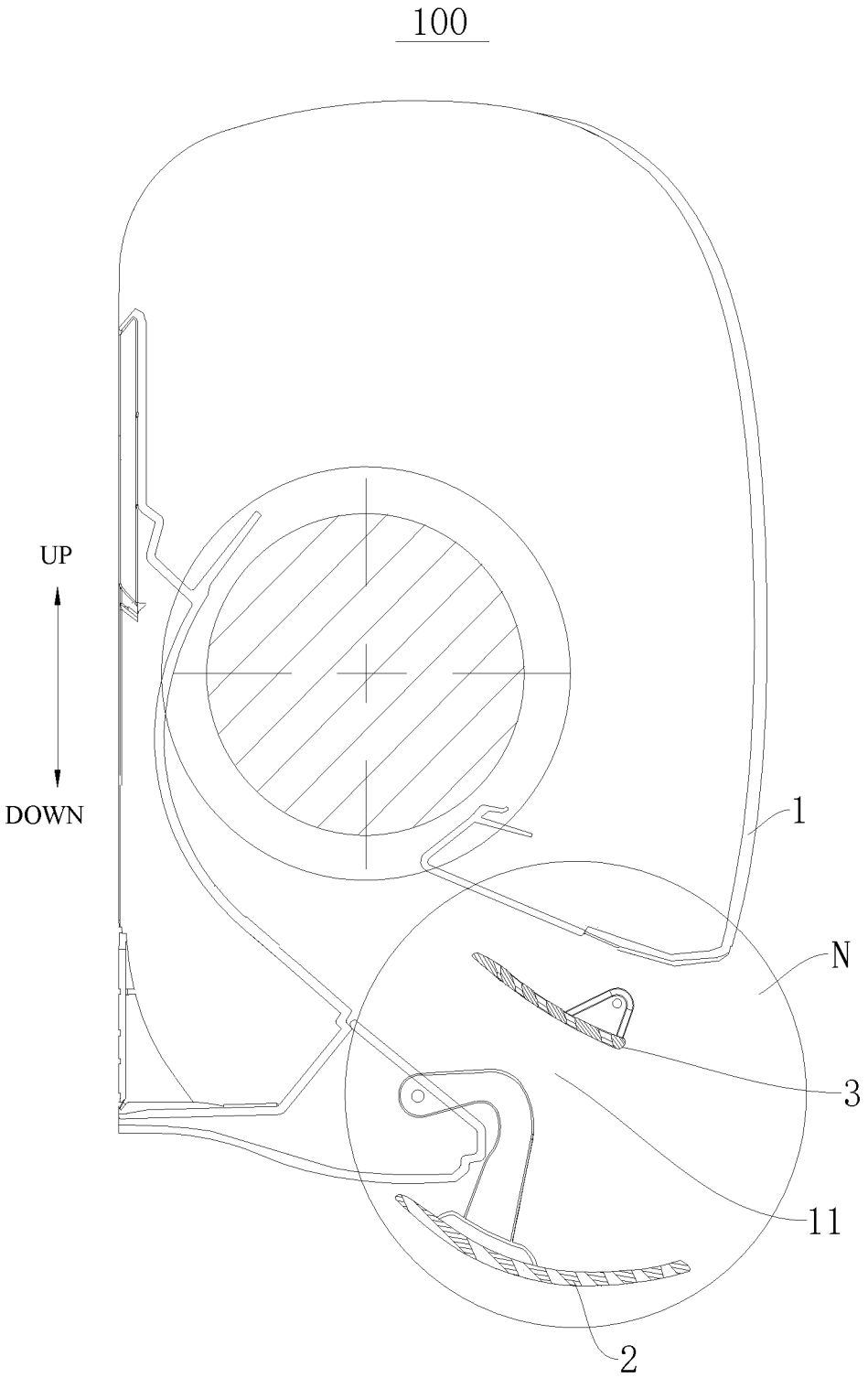
FIG. 6 is a schematic cross-sectional view of the air conditioner indoor unit according to embodiments of the present disclosure, where the outer air deflector opens the air outlet and the inner air deflector is in the second open state.

When the cooling wind/heating wind mode is selected, the outer air deflector 2 opens the air outlet 11, and the inner air deflector 3 rotates to a state in which the inner air deflector 3 is roughly parallel to the air outlet direction, as shown in FIG. 6 and FIG. 7.

When in the first breeze mode, the inner air deflector 3 is rotated to the position perpendicular to the air speed, the wind in the body 1 is blown from the plurality of second vent holes 31, and the air speed is reduced. However, since the hole diameters of the second vent holes 31 are relatively large (the hole diameters of the second vent holes 31 are larger than the hole diameters of the first vent holes 21), there is still breeze, as shown in FIG. 9.

When in the second breeze mode, the outer air deflector 2 is rotated to the closed state, the wind in the body 1 is blown from the plurality of first vent holes 21, and the air speed is reduced. Since the hole diameters of the first vent holes 21 are smaller than those of the second vent holes 31, a slighter breeze effect can be achieved as compared to the first breeze mode, as shown in FIG. 5.

When in the no-wind mode, the outer air deflector 2 is rotated to the closed state, the inner air deflector 3 is rotated to a state in which the inner air deflector 3 is perpendicular to the air outlet direction, the wind in the body 1 is blown from the plurality of second vent holes 31 and the plurality of first vent holes 21 sequentially, thereby reducing the air speed and volume and achieving the no-wind effect, as shown in FIG. 2.

In the description of the present application, it is to be understood that the terms "center," "longitudinal," "horizontal," "length," "width," "thickness," "upper," "lower," "front," "back," "left," "right," "vertical," "horizontal," "top," "bottom," "inside," "outside," "clockwise," "anticlockwise," "axial," "radial," "circumference" and other presentations relating to orientation or positional relationship is based on the orientation or positional relationship shown in the attached figure, and is merely for the convenience of the description of the present disclosure or a simplified description, rather than indicating or implying that the device or component referred to has a specific orientation or is manufactured or operated in a specific orientation, which shall not be construed as limitations on the present disclosure.

In addition, terms "first" and "second," are used only for the description, rather than indicating or implying relative importance or stating implicitly the quantity of the indicated technological features. Therefore a feature associated with "first" and "second" may, explicitly or implicitly, comprise one or more such features. Unless otherwise stated, "a plurality of" means two or more in the description of the present disclosure.

In the description of the present disclosure, unless otherwise expressly specified and defined, the terms "installation," "linking" and "connection" shall be understood generally, for example, it may be fixed connection, detachable connection, or integral connection; or mechanical or electrical connections; or direct linking, indirect linking through an intermediate medium, or internal connection or interaction of two components. The specific meaning of the above terms in the present disclosure may be understood on a case by case basis by common technicians in the field.

In the description of the present disclosure, the terms "an embodiment," "some embodiments," "example," "specific example," or "some examples" etc. mean that the specific feature, structure, material or characteristic of that embodiment or example described are included in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples. In addition, common technicians can combine and integrate the features in any one or multiple embodiment or examples, if no contradiction exists.

Although the embodiments of the present disclosure have been presented and described, the common technicians in the field can understand that various changes, modifications, alternatives and variations of such embodiments can be made without deviating from the principles and purposes of the present disclosure, and that the scope of the invention is defined by the claims and their equivalents.

What is claimed is:

1. An air conditioner indoor unit comprising:

a body including an air outlet, the air outlet being an opening of an outer contour of the body;

a porous outer air deflector arranged at the air outlet and configured to open and close the air outlet, a size of the outer air deflector matching a size of the opening of the outer contour of the body, the outer air deflector including a plurality of first vent holes penetrating the outer air deflector in a thickness direction of the outer air deflector, wherein a ratio of an inlet size with respect to an outlet size of the plurality of first vent holes decreases sequentially from a top of the outer air deflector to a bottom of the outer air deflector; and a porous inner air deflector located upstream of the outer air deflector along an air outlet direction, the inner air deflector including a plurality of second vent holes penetrating the inner air deflector in a thickness direction of the inner air deflector;

wherein in a breeze mode, the outer air deflector closes the air outlet, while the inner air deflector extends into the air outlet and is arranged along the air outlet direction, and air from an inside of the air conditioner indoor unit flows substantially all through the plurality of first vent holes of the outer air deflector to an outside of the air conditioner indoor unit.

2. The indoor unit according to claim 1, wherein one of the plurality of first vent holes and the plurality of second vent holes includes a first hole section and a second hole section connected sequentially in the air outlet direction.

3. The indoor unit according to claim 2, wherein the first hole section tapers gradually in the air outlet direction, and the second hole section expands gradually in the air outlet direction.

4. The indoor unit according to claim 2, wherein an outlet size of the first hole section is larger than an inlet size of the second hole section, a parting surface being formed between the first hole section and the second hole section.

5. The indoor unit according to claim 4, wherein the parting surface is a plane.

6. The indoor unit according to claim 4, wherein a distance between the parting surface and an outlet end of the one of the plurality of first vent holes and the plurality of second vent holes is not more than half of a total length of the one of the plurality of first vent holes and the plurality of second vent holes.

7. The indoor unit according to claim 1, wherein an inlet area of one of the plurality of first vent holes and the plurality of second vent holes is not larger than an outlet area of the one of the plurality of first vent holes and the plurality of second vent holes.

8. The indoor unit according to claim 1, wherein hole diameters of a part of the plurality of first vent holes decrease or increase sequentially from a top of the outer air deflector to a bottom of the outer air deflector, or remain unchanged.

9. The indoor unit according to claim 1, wherein hole diameters of a part of the plurality of second vent holes decrease or increase sequentially from a top of the inner air deflector to a bottom of the inner air deflector, or remain unchanged.

10. The indoor unit according to claim 1, wherein a part of the plurality of first vent holes are arranged sequentially along a straight line or a curve.

11. The indoor unit according to claim 1, wherein a part of the plurality of second vent holes are arranged along a straight line or a curve.

12. The indoor unit according to claim 1, wherein:

a hole diameter of one of the plurality of first vent holes is in a range of 2 mm to 4 mm; and/or a hole diameter of one of the plurality of second vent holes is in a range of 4 mm to 8 mm.

13. The indoor unit according to claim 1, wherein:

the breeze mode is a first breeze mode;

an included angle between a center axis of one of the plurality of first vent holes and a horizontal plane ranges from −10° to 10° when the outer air deflector is in the first breeze mode and flush with the outer contour of the body; and/or an included angle between a center axis of one of the plurality of second vent holes and the horizontal plane ranges from −10° to 10° when the inner air deflector is in a second breeze mode different from the first breeze mode.

14. The indoor unit according to claim 1, wherein a sum of areas of the plurality of second vent holes is no less than 50% of a total area of the inner air deflector.

15. The indoor unit according to claim 1, wherein at least one of the inner air deflector or the outer air deflector is made of at least one of acrylonitrile-styrene- butadiene copolymer (ABS) or polycarbonate (PC).

16. The indoor unit according to claim 1, wherein one of the plurality of first vent holes and the plurality of second vent holes has a round, oval, triangular or polygonal cross section.

17. The indoor unit according to claim 1, wherein hole diameters of a part of the plurality of first vent holes decrease or increase sequentially from a top of the outer air deflector to a bottom of the outer air deflector.

18. The indoor unit according to claim 1, wherein for each of the plurality of first vent holes, an inlet size is smaller than an outlet size.

19. An air conditioner indoor unit comprising:

a body including an air outlet;

an outer air deflector arranged at the air outlet and configured to open and close the air outlet, the outer air deflector including a plurality of first vent holes penetrating the outer air deflector in a thickness direction of the outer air deflector, wherein a ratio of an inlet size with respect to an outlet size of the plurality of first vent holes decreases sequentially from a top of the outer air deflector to a bottom of the outer air deflector; and an inner air deflector located upstream of the outer air deflector along an air outlet direction, the inner air deflector including a plurality of second vent holes penetrating the inner air deflector in a thickness direction of the inner air deflector, hole diameters of the plurality of second vent holes being different from hole diameters of the plurality of first vent holes;

wherein:

in a first breeze mode, the outer air deflector opens the air outlet, while the inner air deflector is flush with an outer contour of the body and at least partially closes the air outlet; and in a second breeze mode, the outer air deflector closes the air outlet, while the inner air deflector extends into the air outlet and is arranged along the air outlet direction.

* * * * *